US007174667B2

(12) United States Patent
Connal

(10) Patent No.: US 7,174,667 B2
(45) Date of Patent: Feb. 13, 2007

(54) HANDGUN BUSHING REMOVAL TOOL

(76) Inventor: Pete Connal, 45615 N. 20th St., New River, AZ (US) 85087

( * ) Notice: Subject to any disclaimer, the term of this patent is extended or adjusted under 35 U.S.C. 154(b) by 35 days.

(21) Appl. No.: 11/031,176

(22) Filed: Jan. 6, 2005

(65) Prior Publication Data

US 2006/0162224 A1 Jul. 27, 2006

(51) Int. Cl.
*F41C 27/00* (2006.01)
*B25B 27/14* (2006.01)
*B25B 13/48* (2006.01)

(52) U.S. Cl. ..... 42/108; 29/270; 7/108

(58) Field of Classification Search ..... 42/108, 42/90; 29/270; 7/118
See application file for complete search history.

(56) References Cited

U.S. PATENT DOCUMENTS

D210,093 S * 2/1968 Bliss ..... D8/34
4,901,411 A 2/1990 Chestnut et al.
4,961,239 A * 10/1990 Boyd et al. ..... 7/118
D407,958 S 4/1999 Royse, III

* cited by examiner

*Primary Examiner*—Michael J. Carone
*Assistant Examiner*—Bret Hayes
(74) *Attorney, Agent, or Firm*—Gregory J. Nelson

(57) ABSTRACT

A tool to facilitate the removal of a barrel bushing on a handgun such as the 1911 automatic pistol. The tool has a handle which foldably receives a wrench having an aperture conforming to the shape of bushing. In the extended position, the wrench is provided with ridges or serrations to frictionally engage the fingers or hands of the user. Additional accessory items such as knife blades or other tools may be foldably secured to the handle.

5 Claims, 1 Drawing Sheet

HANDGUN BUSHING REMOVAL TOOL

FIELD OF THE INVENTION

The present invention relates to a tool and more particularly a tool for assisting in the partial disassembly of a firearm and particularly the popular M 1911 type automatic pistol.

BACKGROUND OF THE INVENTION

The Colt Model 1911 was designed by John Browning, designer of a number of modern firearms. The pistol was initially designed to comply with the requirements of the U.S. Army to replace the .38 caliber revolver. In March 1911, the Browning-designed .45 automatic pistol manufactured by Colt was selected as the official sidearm of the armed forces of the United States of America and was designated the Model 1911. Because of its speed, reliability and distinguished history, the 1911 firearm is still popular today with gun enthusiasts and collectors. Various models of the 1911 have been produced by various manufacturers such as the government model MKIV/80 and an officer's model both manufactured by Colt. Other have been manufactured and produced by various manufacturers such as AMT, Smith & Wesson, Springfield Armory and others.

In order to disassemble the 1911 for repair or to clean the firearm, the procedure for the various models is basically the same. The procedure involves rotation and removal of the barrel bushing and the recoil spring plug. Rotation and disassembly of these parts can sometimes be accomplished by hand without the use of any tools. However, such procedure may be difficult as normal procedure is to depress the recoil spring plug and at the same time rotate the barrel bushing by approximately ¼ turn. Once the barrel bushing has been rotated, the bushing and the barrel can be removed. The manual procedure may be difficult because of the necessity to depress the plug and rotate the barrel at the same time. Therefore, a tool is sometimes used in connection with the rotation of the barrel bushing. The tool may be simply a wrench having an aperture generally in the shape of the barrel bushing which is fitted over the barrel bushing and turned to rotate the barrel bushing.

The prior art also discloses several other types of tools for this purpose. U.S. Design Pat. No. 407958 shows a lockout, safety and bushing removal tool for an automatic handgun.

U.S. Pat. No. 4,901,411 discloses a tool for rotating a barrel bushing or spring plug in a 45 caliber pistol. The tool has a flange to prevent the uncontrolled ejection of the plug and spring. The tool includes a recess for partially receiving the ejected plug. Studs are positioned to control the amount and/or direction of rotation of the bushing or plug.

While tools, as described above, are suitable for the intended purpose, they generally are elongated, wrench-style tools, which are not convenient for the user to carry in a pocket. Often it is necessary for the user to remove the bushing and clean the firearm after firing at a practice range and carrying a bulky wrench is not convenient. Further such tools are single purpose tools.

Accordingly, there exists a need for a compact tool which can be easily carried by the firearm user and which may be used to assist for rotation and removal of the barrel bushing and which includes other accessory devices for the convenience of the user.

BRIEF SUMMARY OF THE INVENTION

Briefly, the present invention provides a compact tool having a handle similar to the handle of a folding knife. The handle foldably receives other accessory items such as a knife blade, can opener, screw driver or other convenience accessory. The blade and other accessories are foldable between a stored position in the handle and in an extended use position. The blade or other item folds about a pivot pin extending through the handle and any liners. The bushing removal tool has a wrench pivotally secured to the handle and is receivable in a stored position in a slot in the handle which may be adjacent to or may be opposite the slot for receiving another accessory item.

The wrench is a generally flat member of suitable material such as a high quality steel. The wrench defines an opening conforming to the shape of the barrel bushing. The upper end of the wrench is generally rounded and may be provided with additional accessory items such as a screwdriver tip. The bushing wrench is extendible from the stored position to the extended position and used to rotate the bushing either in a clockwise or counterclockwise direction as required. The opposite sides of the tool are provided with raised serrations or ridges which extend along the side of the handle and when the wrench is extended to provide a gripping surface to prevent the user's fingers from slipping during use.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
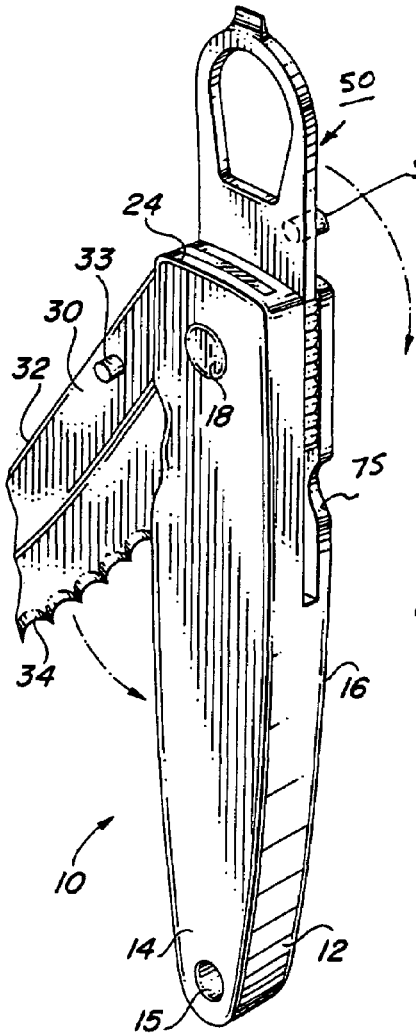
FIG. 1 is a perspective view of the tool of the present invention showing the accessory blade partially extended and the wrench deployed in a position of use.
Figure 3:
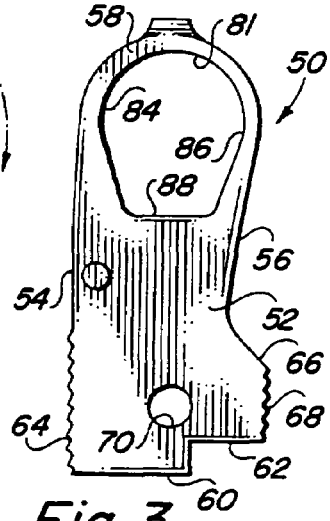
FIG. 3 is a detail of the wrench portion of the tool.

Turning now to the drawings, the tool of the present invention is generally designated by the numeral 10 and includes an elongate handle 12 having opposite sections 14 and 16. The material of the handle may be any suitable material such as wood, plastic or metal and may include liners as is common in the construction of folding knives. The shape, as mentioned, is elongate and may be tapered for convenience. Generally the handle sections are secured by rivets 15. Another fastener 18, such as a rivet or pin, extends through the handle near its upper end 20. The pin 18 also serves as a pivot for the wrench and any additional accessory items.

The handle sections define a first elongate slot 24 which extends along the left side of the handle as seen in FIG. 1. The elongate slot 24 is provided for reception of an accessory item such as a knife blade 30. The knife blade 30 is conventional having a back section 32 and a edge 34 which is shown as serrated. The knife blade is pivotal about pin 18. In the closed position, the blade assumes an out-of-the-way position between the handle sections 14 and 16. In the extended position, the blade is deployed and extends forwardly from the handle. A projection 33 on the blade is provided to assist the user in unfolding the blade. The construction described above is representative of the general construction of various folding knives such as those manufactured Buck, Case and others.

While the tool of the present invention has been described above having an accessory such as a knife blade, it will be apparent that other types of accessory items can be provided. These may include such items as can openers, screwdrivers and the like. It is not necessary that the tool of the present invention include accessory items, but it is preferred that other accessory items in addition to the bushing wrench be provided for the convenience of the user making the tool a multi-purpose tool.

Figure 2:
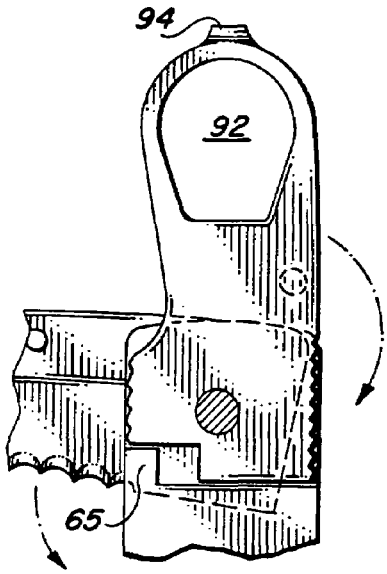
FIG. 2 is a partial detail of the end of the tool of the present invention again showing the wrench in an extended, use position.
Figure 6:
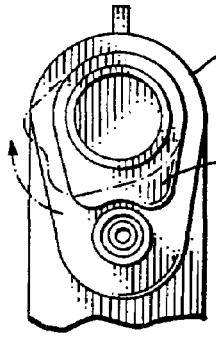
FIG. 6 is a view of the end of the barrel of a representative firearm showing the bushing rotated to a release position in dotted lines.

A wrench 50 is shown in the extended or deployed position in FIGS. 1 and 2. The wrench 50 has a generally flat body 52 of suitable material such as a tool steel. The body 52 has a first side 54 and opposite side 56 and a generally curved upper end 58. The lower end 60 is generally flat and may be notched at 62 to provide a stop surface. A plurality of ridges or serrations 64 are provided along first side 54. Similarly, a section of body 52 projects outwardly at 66 also having a plurality of ridges or serrations 68. The ridges or serrations 68 are to provide frictional engagement with the user's hand when the wrench is in the extended, use position.

The body defines an aperture 70 through pivot pin 18 extends. The overall width of the body generally conforms to the width of the handles or may be slightly greater so the serrations 64, 68 on either side of the body extend slightly beyond the sides of the handle 12 in the open position.

The upper end of the wrench has downwardly extending converging sides 84, 86 and bottom 88 and arcuate side 89 forming an opening or aperture 92. The shape and configuration of the aperture 92 may vary somewhat depending upon the model of the firearm with which the tool is to be used. The exact shape of the aperture will correspond to the shape of the barrel bushing with which the tool is designed to be used.

A projection 94 on the upper end of the wrench serves as a tool for adjusting screws on the firearm such as the setscrews on the rear sights. The projection 94 provides added features and benefits and is located in a convenient position so that when the wrench is extended, the screwdriver tip may be used in conventional fashion. A pin 55 is provided to assist the user in lifting the wrench. When the wrench is folded, the pin is received in notch 75 in the handle so it may be accessed.

The use of the tool will now be described. The tool, as mentioned, is intended to be used with the model 1911 handguns. Although there are various manufacturers and models of the handgun, the tool is adaptable for use with these various models. The barrel of the representative 1911 handgun is generally represented by the numeral 100 and has a bushing 110 at the forward end of the barrel. Below the bushing is a bore 112 that extends parallel to the barrel bore having a spring 114 retained by a plug 116. To clean or repair the firearm 100, the barrel bushing must first be removed. The tool of the present invention is used for this purpose and is placed in use position by pivoting the wrench end to a use position extending from the handle as shown in FIG. 1. The wrench is maintained in the open position by the engaging of notch 62 with shoulder 65 as seen in FIG. 2. These elements form stop means to limit the rotation of the wrench. Generally, other accessory items such as the blade will be folded to a non-use position. In the use position, the serrations or ridges extend along the handle at opposite sides at the upper end of the handle to assist the user and prevent the user's fingers or hands from slipping during use. Opening the wrench is facilitated by pin 55.

Figure 5:
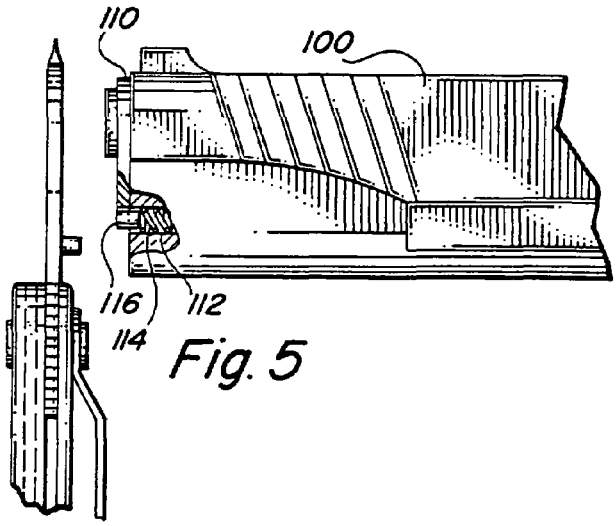
FIG. 5 shows the end of a barrel of a representative firearm such as a model 1911 handgun with the tool positioned prior to engagement with the bushing.

As shown in FIG. 5, the wrench is aligned with the barrel bushing and the aperture 92 is placed around the periphery of the barrel bushing. The barrel bushing then may be rotated by manually applying rotational force to the handle of the tool. Generally, the bushing requires only rotation of about a ¼ turn. The direction of rotation required to loosen the bushing may depend upon the make and model of the particular firearm. The flat surface of the wrench will hold the spring plug 116 in position and, once the bushing is loosened, the tool may be slowly removed allowing the recoil spring to extend. Once the bushing is loosened, the bushing may be removed as well as the barrel and other components to allow the user to fully clean and service the firearm.

Figure 4:
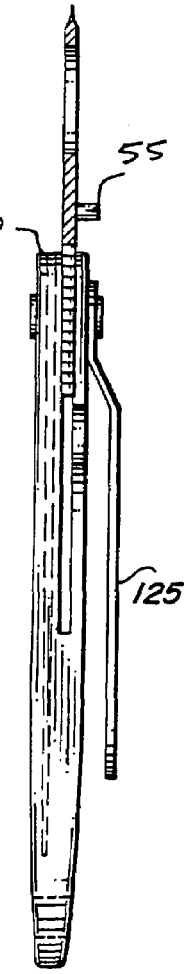
FIG. 4 is a side view of the tool of the present invention with the wrench in an extended position.

A belt clip 125 may also be provided for convenience and the user may conveniently carry the tool in a pocket or may attach the tool to the belt by use of the elongate belt clip. It will be obvious other accessory components can be provided and in the event the user has several 1911 models which require wrenches having apertures of different shapes, a second wrench can be provided at the opposite end of the handle as seen in FIG. 4.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A tool for rotating the barrel bushing of a 1911 model firearm comprising:

(a) an elongate handle having sides and an end and defining a slot extending along one side, said one side defining a recess;

(b) a generally planar wrench pivotally coupled to said handle having a stored position in which the wrench is received in said slot and an open, use position in which the wrench extends from said end;

(c) said wrench having an upper end and opposite sides, said wrench defining an aperture corresponding to the shape of a barrel bushing;

(d) at least one side of said wrench defining serrations which in the extended position align with said slot to provide a surface which is engageable by a user's hand;

(e) a projection on said wrench which aligns with said recess when the wrench is in the stored position to assist a user in opening the wrench; and (f) stopping means to limit the rotation of the wrench when pivoted to the use position.

2. The tool of claim 1 wherein said wrench includes a screwdriver tip at the upper end thereof.

3. The tool of claim 1 wherein said handle pivotally carries an additional accessory tool.

4. The tool of claim 1 wherein said aperture shape corresponds to the shape of a bushing of a 1911 model firearm.

5. The tool of claim 1 further including a belt clip carried on said handle.

* * * * *